US011370646B2

(12) United States Patent
Doblinger et al.

(10) Patent No.: US 11,370,646 B2
(45) Date of Patent: Jun. 28, 2022

(54) DEVICE AND METHOD FOR FILLING A FILL PRODUCT INTO A CONTAINER TO BE FILLED IN A BEVERAGE BOTTLING PLANT

(71) Applicant: KRONES AG, Neutraubling (DE)

(72) Inventors: Josef Doblinger, Neutraubling (DE); Holger Mueller, Neutraubling (DE); Franz Braun, Neutraubling (DE); Christian Gebauer, Neutraubling (DE); Angela Gruenwald, Neutraubling (DE); Bruno Landler, Neutraubling (DE); Sebastian Passberger, Neutraubling (DE)

(73) Assignee: KRONES AG, Neutraubling (DE)

( * ) Notice: Subject to any disclaimer, the term of this patent is extended or adjusted under 35 U.S.C. 154(b) by 125 days.

(21) Appl. No.: 16/702,324

(22) Filed: Dec. 3, 2019

(65) Prior Publication Data

US 2020/0180929 A1 Jun. 11, 2020

(30) Foreign Application Priority Data

Dec. 5, 2018 (DE) ..... 10 2018 131 077.3

(51) Int. Cl.
*B67C 3/10* (2006.01)
*B67C 3/14* (2006.01)
(Continued)

(52) U.S. Cl.
CPC ..... *B67C 3/10* (2013.01); *B67C 3/045* (2013.01); *B67C 3/06* (2013.01); *B67C 3/14* (2013.01); *B67C 3/2617* (2013.01)

(58) Field of Classification Search
CPC .. B67C 3/10; B67C 3/045; B67C 3/06; B67C 3/14; B67C 3/2617
See application file for complete search history.

(56) References Cited

U.S. PATENT DOCUMENTS 3,478,785 A * 11/1969 Hermann ..... B67C 3/12 141/39
3,626,996 A * 12/1971 Bingham ..... B67C 3/06 141/5
(Continued)

FOREIGN PATENT DOCUMENTS

CN 106348235 A 1/2017
CN 107848784 A 3/2018
(Continued)

OTHER PUBLICATIONS

European Search Report and Written Opinion as issued in connection with European Patent Application No. 19213956, dated May 12, 2020.

*Primary Examiner* — Nicolas A Arnett
(74) *Attorney, Agent, or Firm* — Maschoff Brennan

(57) ABSTRACT

A device for filling a fill product into a container to be filled in a beverage bottling plant. The device includes a fill product reservoir for storing the fill product, a fill product channel, and a filling member in fluid communication with the fill product reservoir via the fill product channel. The filling member is configured to introduce the fill product into the container to be filled and the filling member communicates via media channels to provide media flows for two or more functions: flushing the container with a flushing gas, pre-pressurizing the container before it is filled, returning gas displaced during the filling of the container, relieving a gas overpressure in the container, and circulating a hot fill product through the filling member for controlling a temperature. A single media channel of the media channels is configured to provide the media flows for at least two of the functions.

18 Claims, 2 Drawing Sheets

(51) Int. Cl.

| | |
|---|---|
| ***B67C 3/26*** | (2006.01) |
| ***B67C 3/04*** | (2006.01) |
| ***B67C 3/06*** | (2006.01) |

(56) References Cited

U.S. PATENT DOCUMENTS

| | | | | | |
|---|---|---|---|---|---|
| 3,834,429 | A * | 9/1974 | Schulz | G01M 3/3236 | 141/83 |
| 3,886,982 | A * | 6/1975 | Uth | B67C 3/06 | 141/39 |
| 4,390,048 | A | 6/1983 | Zelder | | |
| 5,000,234 | A * | 3/1991 | Weiss | B67C 3/10 | 141/40 |
| 5,065,799 | A * | 11/1991 | Weiss | B67C 3/10 | 141/39 |
| 5,413,153 | A * | 5/1995 | Zwilling | B65B 39/004 | 141/302 |
| 5,884,677 | A * | 3/1999 | McKaughan | B67C 3/2628 | 141/145 |
| 5,924,462 | A * | 7/1999 | McKaughan | B67C 3/2628 | 141/145 |
| 6,308,752 | B1 * | 10/2001 | Tsukano | F17C 5/002 | 141/290 |
| 8,251,107 | B2 * | 8/2012 | Clusserath | B67C 3/045 | 141/59 |
| 8,459,315 | B2 * | 6/2013 | Clusserath | B67C 3/004 | 141/90 |
| 2005/0241726 | A1 * | 11/2005 | Clusserath | B67C 3/286 | 141/144 |
| 2005/0257499 | A1 * | 11/2005 | Krulitsch | B67C 3/2614 | 53/281 |
| 2010/0071802 | A1 | 3/2010 | Clusserath et al. | | |
| 2013/0061980 | A1 | 3/2013 | Clusserath | | |
| 2016/0060087 | A1 * | 3/2016 | Clusserath | B67C 3/2614 | 53/432 |

FOREIGN PATENT DOCUMENTS

| | | | |
|---|---|---|---|
| DE | 1076518 | B | 2/1960 |
| DE | 3024099 | A1 | 1/1982 |
| DE | 4342142 | A1 | 6/1995 |
| DE | 19836500 | A1 | 2/2000 |
| DE | 102007014702 | A1 | 9/2008 |
| DE | 102010024522 | A1 | 12/2011 |
| DE | 102012024532 | A1 | 6/2013 |
| DE | 102013103639 | A1 | 10/2014 |
| EP | 0331137 | A1 | 9/1989 |
| EP | 1584601 | A1 | 10/2005 |

* cited by examiner

DEVICE AND METHOD FOR FILLING A FILL PRODUCT INTO A CONTAINER TO BE FILLED IN A BEVERAGE BOTTLING PLANT

CROSS-REFERENCE TO RELATED APPLICATION

This application claims priority to German Patent Application No. 10 2018 131 077.3, filed on Dec. 5, 2018.

FIELD

The present invention relates to a device and a method for filling a fill product into a container to be filled in a beverage bottling plant, for example for filling a carbonated beverage or for hot-filling a beverage.

BACKGROUND

Devices and methods for filling beverages are known. Such devices generally comprise a fill product reservoir, in which the fill product to be filled is received prior to filling, and a filling member which is in fluid communication with the fill product reservoir via a fill product channel.

For filling carbonated beverages, devices are known in which the container to be filled is pre-pressurized, before it is filled, with a pressurizing gas to a pre-pressurizing pressure. For this purpose, the filling member is brought into sealing contact with an opening of the container to be filled, and the pressurizing gas is then introduced from the filling member into the container. The pre-pressurizing pressure in the container reduces or prevents outgassing of carbon dioxide from the fill product when the container is subsequently filled with the carbonated fill product.

Devices are known in which the filling member is in fluid communication with a gas region of the fill product reservoir by means of a media channel, also called a pre-pressurizing channel. The gas region of the fill product reservoir contains a gas, mostly carbon dioxide, which is present in the fill product reservoir at a predefined pressure and prevents outgassing of carbon dioxide from the carbonated fill product in the fill product reservoir. Consequently, the gas from the fill product reservoir in the form of pressurizing gas is used as the pre-pressurizing gas in these devices. The gas mixture present in the container after pre-pressurization, comprising the pre-pressurizing gas and gases which were already present in the container beforehand, mostly air, is displaced, during filling of the container, by the inflowing fill product from the container into the pre-pressurizing channel and, in particular when the fill product reservoir is in the form of an annular reservoir, can enter the fill product reservoir and contaminate the gas atmosphere therein.

After filling, the gas overpressure in the container is relieved via a further media channel, the so-called relief channel. The pressurized gas in the container is thereby discharged via the relief channel into the environment or into the open air.

In the case of the filling of carbonated beverages which react sensitively to the presence of oxygen, such as, for example, beer, the container to be filled is additionally flushed with pure carbon dioxide prior to pre-pressurization. The oxygen in the air which is initially in the container to be filled can thus be flushed out of the container before filling. For this purpose, the filling member is connected to an additional media channel, the pure-CO2 channel, which delivers pure carbon dioxide to the filling member. The carbon dioxide flows through the pure-CO2 channel into the container and displaces first the air and, later in the flushing process, the air/CO2 gas mixture from the container into the open relief channel and, further, into the environment. A disadvantage here is that, as well as the pre-pressurizing line, there are additionally to be provided the pure-CO2 channel and corresponding valves for opening and closing the pure-CO2 channel, which makes the construction of such devices more complex and consequently increases the manufacturing and maintenance costs.

There are further known devices and methods for hot-filling, in which the fill product is subjected to a heat treatment before it is filled into the container, in order to kill germs present in the fill product and to achieve a predefined or required microbiological stability. The filling member and the container are sterilized concomitantly during the filling operation by the hot-filled fill product. During filling, the fill product delivered to the filling member through the fill product channel displaces gases present in the container, mostly air, which are discharged into the environment via a relief channel. In order to avoid the fill product standing in the fill product channel and/or in the filling member when the filling valve of the filling member is closed or during a break in production and, as a result, the fill product and/or the filling member cooling to below the required filling temperature, devices for hot-filling comprise a further media channel in the form of a hot-return channel. The hot-return channel is connected to the filling member and allows the hot fill product to circulate in the filling member, or in the device, when the filling valve is closed.

Moreover, devices are known which are suitable for filling a fill product into a container by means of a carbonated filling method and a hot-filling method. This type of device is suitable in particular when mainly carbonated beverages are to be filled and, in addition, a few beverages are to be hot-filled. For this purpose, devices are known which comprise, in addition to the fill product channel, on the one hand a pre-pressurizing channel and a relief channel and, in addition, a hot-return channel. For filling oxygen-sensitive carbonated products, a further pure-CO2 channel is additionally to be provided. Owing to the large number of media channels which are to be provided in addition to the fill product channel, and their switch functions and switch valves, devices for the combined filling of carbonated beverages and hot beverages have a complex construction and are correspondingly large, expensive and high-maintenance.

SUMMARY

A device for filling a fill product into a container to be filled in a beverage bottling plant. The device includes a fill product reservoir for storing the fill product, a fill product channel, and a filling member in fluid communication with the fill product reservoir via the fill product channel. The filling member is configured to introduce the fill product into the container to be filled and the filling member communicates via media channels to provide media flows for two or more functions: flushing the container with a flushing gas before it is filled with the fill product, pre-pressurizing the container with a pressurizing gas to a pre-pressurizing pressure before it is filled with the fill product, returning gas displaced during the filling of the container with the fill product, relieving a gas overpressure in the container after filling the container with the fill product, and circulating a hot fill product through the filling member for controlling a temperature of the filling member. In some embodiments, a single media channel of the media channels is configured to provide the media flows for at least two of the functions.

BRIEF DESCRIPTION OF THE FIGURES

Embodiments of the invention will be explained in greater detail by the following description of the figures, in which.

DETAILED DESCRIPTION

Figure 1:
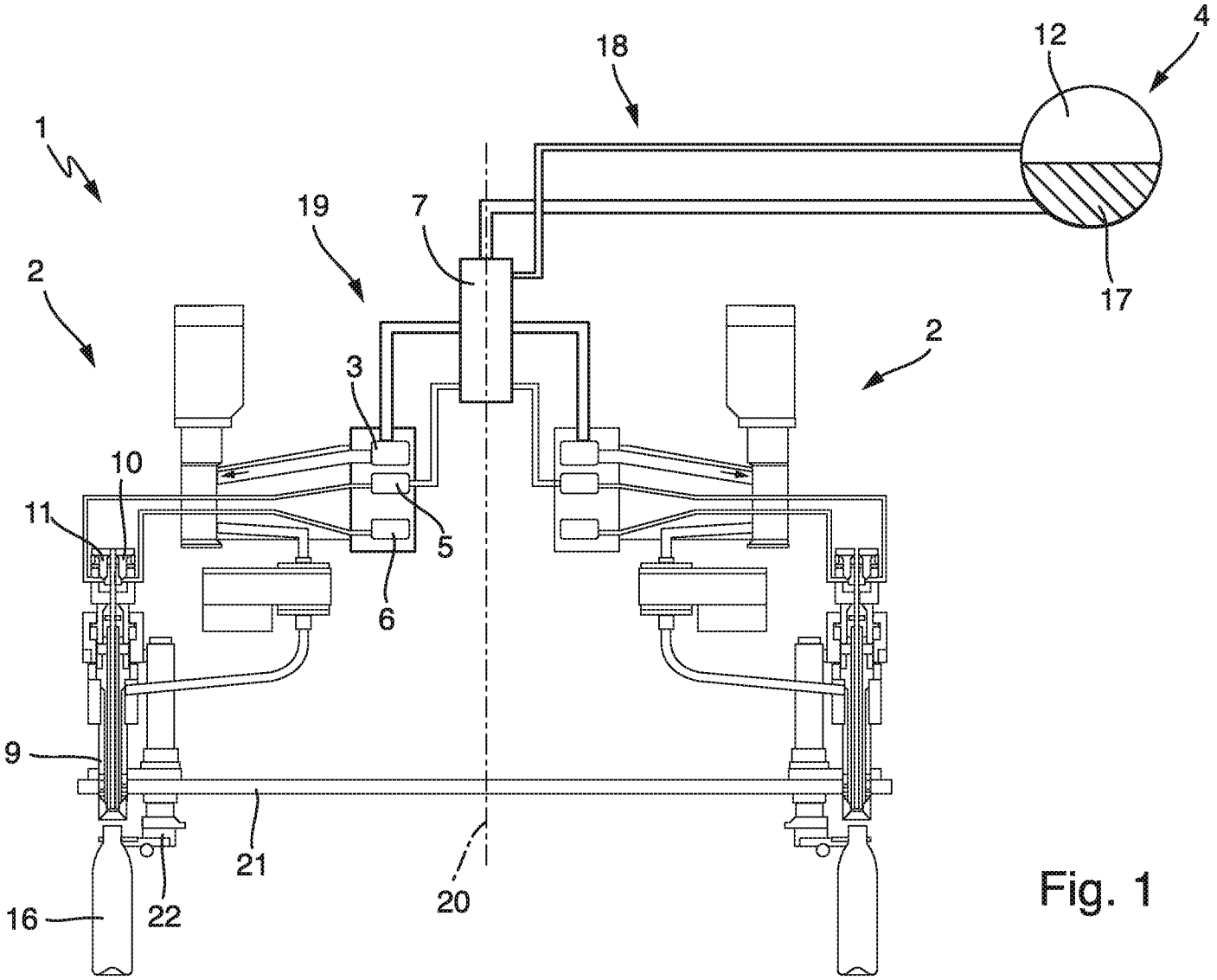
FIG. 1 is a schematic side view of a device for filling a fill product into a container to be filled according to a first embodiment.

The present invention provides an improved device for filling a fill product into a container to be filled in a beverage bottling plant, for example for filling a carbonated beverage or for hot-filling a beverage, and a corresponding method.

In some embodiments, a device for filling a fill product into a container to be filled in a beverage bottling plant, for example for filling a carbonated beverage or for hot-filling a beverage, haves the features of claim 1. Advantageous further developments follow from the dependent claims.

Accordingly, there is described a device for filling a fill product into a container to be filled in a beverage bottling plant, for example for filling a carbonated beverage or for hot-filling a beverage, comprising a fill product reservoir and a filling member, which is in fluid communication therewith via a fill product channel, for introducing the fill product into the container to be filled, wherein the filling member communicates via media channels for providing media flows for the functions during the filling operation of flushing the container with a flushing gas before it is filled with the fill product, and/or of pre-pressurizing the container with a pressurizing gas to a pre-pressurizing pressure before it is filled with the fill product in the case of the filling of a carbonated fill product, and/or of returning gas displaced during the filling of the container with the fill product, and/or of relieving a gas overpressure which has built up in the container after filling with the fill product, and/or of circulating a hot fill product through the filling member for controlling the temperature of the filling member in the case of hot-filling. According to the invention, one media channel is allocated at least two of the above-mentioned functions.

Because one media channel is allocated at least two of the above-mentioned functions, the number of channels required for providing the media flows of the functions is reduced. Consequently, the device can be of a simpler construction than devices known from the prior art. Moreover, because of the dual allocation, different types of filling method can be carried out on the same device.

According to a further embodiment, the one media channel is adapted to flush the container before it is filled with the fill product and to pre-pressurize the container to a pre-pressurizing pressure before it is filled with the fill product. An additional pure-CO2 channel is thus not required. Flushing of the container, as well as pre-pressurizing of the container, is carried out using gas from the fill product reservoir. The amount of gas removed from the fill product reservoir for flushing is constantly fed back into the fill product reservoir.

According to a further embodiment, the device is adapted in a first operating state to fill a carbonated fill product and in a second operating state to hot-fill a fill product, wherein one of the functions performed via the one media channel is associated with the first operating state and the other of the functions performed via the same media channel is associated with the second operating state. As a result, it is possible to fill both a carbonated fill product and a hot fill product in the device without having to provide each function of the two operating modes with its own additional media channels, which remain unused when the device is being operated in the respective other operating state.

A particularly simple and effective construction of the device is achieved if, according to a further embodiment, the one media channel is adapted in the first operating state to perform the functions of flushing the container before it is filled with the fill product and of pre-pressurizing the container to a pre-pressurizing pressure before it is filled with the fill product, and is adapted in the second operating state to allow gas displaced from the container during filling of the fill product to flow back.

The media channel is in fluid communication with the fill product reservoir, a gas region of the fill product reservoir.

If one media channel according to a further embodiment is adapted in the first operating state to relieve a gas overpressure which has built up in the container after filling with the fill product and is adapted in the second operating state to circulate a hot fill product through the filling member for controlling the temperature of the filling member in the case of hot-filling, an additional return channel is not required and the required circulation of the hot fill product can nevertheless be made possible.

A particularly simple construction of the device can be achieved if, according to a further embodiment, exactly two media channels are provided. The manufacturing costs and the effort in terms of maintenance of the device are reduced correspondingly. A first media channel of the exactly two media channels is adapted in the first operating state to perform the functions of flushing the container before it is filled with the fill product and of pre-pressurizing the container to a pre-pressurizing pressure before it is filled with the fill product, and is adapted in the second operating state to allow gas displaced from the container during filling of the fill product to flow back, and/or a second media channel of the exactly two media channels is adapted in the first operating state to relieve a gas pressure which has built up in the container after filling with the fill product and is adapted in the second operating state to circulate a hot fill product through the filling member for controlling the temperature of the filling member in the case of hot-filling.

According to a further embodiment, the fill product reservoir is in the form of an adjacent fill product reservoir. As a result, correspondingly long channel lengths are obtained between the filling member and the fill product reservoir, so that the media channel functions as a buffer when the gas displaced from the container is returned. In other words, the volume in the one media channel, through which gas displaced during filling of the container with the fill product flows back, is sufficiently large that the backflowing gas does not reach the fill product reservoir. Contamination of the fill product reservoir with contaminated gas present in the container and/or air is thus ruled out.

A media distributor for distributing the media provided by the fill product reservoir is arranged between the fill product reservoir and the filling member. The construction of the device can thus be simplified further. The media distributor divides the media channels into a reservoir-distributor portion and a distributor-filling member portion. If the device comprises a plurality of filling members, the reservoir-distributor portion can be formed in a common channel for all the filling members. The filling members are then each connected to the media distributor via their own distributor-filling member portions of the media channels and connected by the media distributor to the adjacent fill product reservoir by means of the common reservoir-distributor portions of the media channels.

In order to allow the circulation of the hot fill product to be connected in and blocked in the case of hot-filling, there is provided at the filling member according to a further embodiment a return-switch valve for providing a fill product stream from the filling member into the media channel that is allocated the function of circulating the hot fill product.

Furthermore, there can be provided at the media channel that is allocated the function of returning gas displaced during filling of the container with the fill product a switch valve and/or a non-return valve for preventing a gas stream into the fill product reservoir, and/or there can be provided a venting valve for releasing gas or gas mixture from the media channel into the environment, wherein the venting valve is controllable/adjustable via a switch position of the switch valve and/or of the non-return valve.

In order to increase the efficiency of the device in the first operating state still further, the one media channel for flushing and for pre-pressurizing the container in the first operating state can, according to a further embodiment, be adapted to use gas or gas mixture displaced from the container into the media channel during filling of the fill product into a container for flushing and/or pre-pressurizing at least one further container that is to be filled.

According to a further embodiment, the filling member comprises a filling valve, wherein the return-switch valve is adapted in the second operating state, with the filling valve closed, to allow the fill product which has flowed from the fill product channel into the filling member to flow into the media channel that is allocated the function of circulating the hot fill product. Control of the temperature of the filling member and maintenance of the required filling temperature of the hot fill product are thus made possible. Furthermore, it is ensured by the return-switch valve that no fill product flows into the media channel during filling of the container, which would otherwise reduce the filling capacity of the device.

For precise control/adjustment of the media flows required for the functions, it is possible according to a further embodiment for the media channel that is allocated the function of flushing and/or pre-pressurizing the container to comprise a pre-pressurizing valve for connecting the filling member to the media channel, and/or for the media channel that in the first operating state is allocated the function of relieving the gas overpressure which has built up in the container to comprise a relief valve for releasing gas or gas mixture from the filling member into the media channel.

According to a further embodiment, the media channel that in the first operating state is allocated the function of relieving the gas overpressure which has built up in the container and in the second operating state is allocated the function of circulating the hot fill product comprises a further switch valve for selectively providing fluid communication with the fill product reservoir and/or the fill product channel or with the environment.

In order to be able to fill a plurality of containers at the same time and thus increase the filling capacity of the device, the device comprises according to a further embodiment a plurality of filling members. The plurality of filling members are arranged on a transport device of the device, a carousel-type transport device, wherein the filling members are each connected to the media distributor by their own media channels and there are common media channels between the media distributor and the fill product reservoir.

According to a further embodiment, in the first operating state, gas or gas mixture which has been displaced from the container during filling of the fill product into a container and returned into the media channel is provided for pre-pressurizing at least one further container. The gas volume flow required for operating the device in the first operating state can thus be reduced by the amount of returned gas. Because more gas is required for flushing the containers than flows back from the container on filling, it is ensured, in particular when the fill product reservoir, that the gas flow, when seen from the fill product reservoir, always flows in the direction towards the filling member. Contamination of the fill product reservoir is consequently not possible.

In some embodiments, a method for filling a fill product into a container to be filled in a beverage bottling plant, for filling a carbonated beverage or for hot-filling a beverage, has the features of claim 15. Advantageous further developments of the method follow from the dependent claims as well as from the present description and the figures.

Accordingly, there is proposed a method for filling a fill product into a container to be filled in a beverage bottling plant, for filling a carbonated beverage or for hot-filling a beverage, wherein the fill product is conveyed from a fill product reservoir via a fill product channel to a filling member for introducing the fill product into the container to be filled, wherein the filling member communicates via media channels for providing media flows for the functions during the filling operation of flushing a container to be filled with a flushing gas before it is filled with the fill product, and/or of pre-pressurizing the container with a pressurizing gas to a pre-pressurizing pressure before it is filled with the fill product in the case of the filling of a carbonated fill product, and/or of returning gas displaced during filling of the container with the fill product, and/or of relieving a gas overpressure which has built up in the container after filling with the fill product, and/or of circulating a hot fill product through the filling member for controlling the temperature of the filling member in the case of hot-filling. According to the invention, one media channel is used for at least two of the above-mentioned functions.

The effects and advantages described in connection with the device are achieved analogously by the method.

According to a further development, the one media channel is used for flushing the container before it is filled with the fill product and for pre-pressurizing the container to a pre-pressurizing pressure before it is filled with the fill product.

According to a further development, in a first operating state a carbonated fill product is filled into the container and in a second operating state a hot fill product is filled into the container, wherein one of the functions performed via the one media channel is associated with the first operating state and the other of the functions performed via the same media channel is associated with the second operating state.

According to a further development, the one media channel is used in the first operating state for performing the functions of flushing the container before it is filled with the fill product and of pre-pressurizing the container to a pre-pressurizing pressure before it is filled with the fill product, and is used in the second operating state for allowing gas displaced from the container during filling of the fill product to flow back.

According to a further development, one media channel is used in the first operating state for relieving a gas overpressure which has built up in the container after filling with the fill product and is used in the second operating state for circulating a hot fill product through the filling member for controlling the temperature of the filling member in the case of hot-filling.

According to a further development, exactly two media channels are used for providing media flows for the functions.

According to a further development, gas or gas mixture which has been displaced from the pre-pressurized container during filling of the fill product into a container pre-pressurized with the pressurizing gas and returned into the media channel is used for pre-pressurizing at least one further container.

According to a further development, in the second operating state, the gas or gas mixture which has been displaced during filling and returned into the media channel is discharged into the environment.

Embodiments are described hereinbelow with reference to the figures. Elements which are the same, similar or have the same effect are provided with identical reference numerals in the various figures, and in some cases there is no repeat description of these elements, in order to avoid redundancies.

FIG. 1 shows, schematically, a side view of a device 1 for filling a fill product 17 into a container 16 to be filled according to a first embodiment. For filling the container 16 to be filled with the fill product, a plurality of filling members 2 is provided for introducing the fill product 17 into a container 16 to be filled which is arranged beneath the respective filling member 2. The plurality of filling members 2 are arranged on a transport device 21 which is rotatable about an axis of rotation 20, for example on the periphery of a filling carousel.

The device 1 further comprises a fill product reservoir 4 which is situated stationarily next to the transport device 21, wherein the filling members 2 are in fluid communication with the fill product reservoir 4 via a common fill product channel 3.

As well as being in fluid communication with the fill product channel 3, the filling members 2 are in fluid communication with exactly two further media channels 5, 6.

In the configuration shown in FIG. 1, a first media channel 5 is in fluid communication with a gas region 12, or head space, of the fill product reservoir 4. In the gas region 12 of the fill product reservoir 4 there is a pressurizing gas which is usually in the form of carbon dioxide and is at a predefined pre-pressurizing pressure. A second media channel 6 provides venting of the container interior into the environment or into the open air.

Between the fill product reservoir 4 and the filling members 2 there is arranged a media distributor 7, which distributes the media provided by the fluid product reservoir 4, consequently the fill product 17 and the pressurizing gas, to the individual filling members 2. The media distributor 7 thereby divides the fill product channel 3 and the first media channel 5 into a reservoir-distributor portion 18 and a distributor-filling member portion 19, wherein the reservoir-distributor portion 18 is formed for all the filling members 2 in a common fill product channel 3 and a common first media channel 5.

In the distributor-filling member portion 19, the filling members 2 are each connected to the media distributor 7 via their own portions of the fill product channel 3 and portions of the first media channel 5. A plurality of filling members 2 can also be connected via common portions to the media distributor 7.

The device 1 will be described further by way of example hereinbelow with reference to one of the plurality of filling members 2, which have the same construction.

The filling member 2 comprises a container holder 22 in which a container 16 to be filled is held. Via the container holder 22, the container 16 can be brought into sealing contact with the filling member 2. In order to control or adjust the flow of the fill product 17 into the container 16, a filling valve 9 is provided in the filling member 2. In order to connect the filling member 2 to the first media channel 5, a pre-pressurizing valve 11 is further provided, and in order to connect the filling member 2 to the second media channel 6, a relief valve 10 is provided.

The filling of an oxygen-sensitive, carbonated fill product 17, for example beer, into containers 16 to be filled will be described hereinbelow. Once the container 16 has been transferred from a transfer device, not shown, to the container holder 22, the container 16 is brought into sealing contact with the filling member 2, the filling valve 9 of which is closed.

Flushing of the container 16 with flushing gas is then carried out, in order to remove air, and in particular the oxygen contained in the air, which is initially present in the container 16 to be filled, from the container 16 before it is filled. For the flushing, the relief valve 10 and the pre-pressurizing valve 11 are each brought into an open position, so that the carbon dioxide coming from the fill product reservoir 4 is able to flow from the first media channel 5 via the filling member 2 into the container 16. The carbon dioxide which has flowed into the container 16 displaces first the air and, later in the flushing process, the air/CO2 gas mixture out of the container 16 into the open second media channel 6 and, via the vent, further into the environment.

After the container 16 has been flushed, the relief valve 10 is closed again, so that a pre-pressurizing pressure corresponding to the pre-pressurizing pressure in the fill product reservoir 4 is established in the container 16 as a result of the carbon dioxide which is still flowing in. The pre-pressurizing pressure in the container 16 reduces or prevents outgassing of carbon dioxide from the fill product 17 when the container 16 is later filled with the carbonated fill product 17.

Consequently, the gas from the fill product reservoir 4 is used both as flushing gas and as pressurizing gas. The first media channel 5 is consequently adapted both for flushing the container 16 before it is filled with the fill product 17 and for pre-pressurizing the container 16 to a pre-pressurizing pressure before it is filled with the fill product 17.

After the pre-pressurization, the filling valve 9 is opened, so that the fill product 17 flows into the pre-pressurized container 16. The gas present in the container 16 after the pre-pressurization is displaced by the inflowing fill product 17 from the container 16 via the open pre-pressurizing valve 11 into the first media channel 5 and optionally into the media distributor 7. The first media channel 5 is consequently additionally adapted to allow a backflow of gas displaced during filling of the container 16 with the fill product 17.

The media channel 5 is thus used to provide the flushing gas, to provide the pressurizing gas and to receive the backflow of gas displaced from the container 16 during filling.

Once the container 16 has been filled, the filling valve 9 and the pre-pressurizing valve 11 are closed and the gas overpressure in the container is discharged via the now open relief valve 10 into the second media channel 6, until the gas overpressure built up in the container 16 after filling with the fill product 17 has been relieved in a controlled manner to ambient pressure, in order that the container 16 can then be separated from the filling member. The pressurized gas in the container 16 is thereby discharged via the second media channel 6 and the vent into the environment or into the open air.

Because more gas is required for flushing the containers than flows back on filling of the containers, it is ensured that gas always flows from the fill product reservoir 4 in the direction towards the media distributor 7. Contamination of the fill product reservoir 4 by gas which has returned from the containers 16 is consequently not possible. This is the case in particular because, owing to the adjacent fill product reservoir 4 and the common reservoir-distributor portion 18 connected thereto, in conjunction with the flow conditions in the reservoir-distributor portion 18, a gas volume flow directed out of the fill product reservoir 4 is always present.

Figure 2:
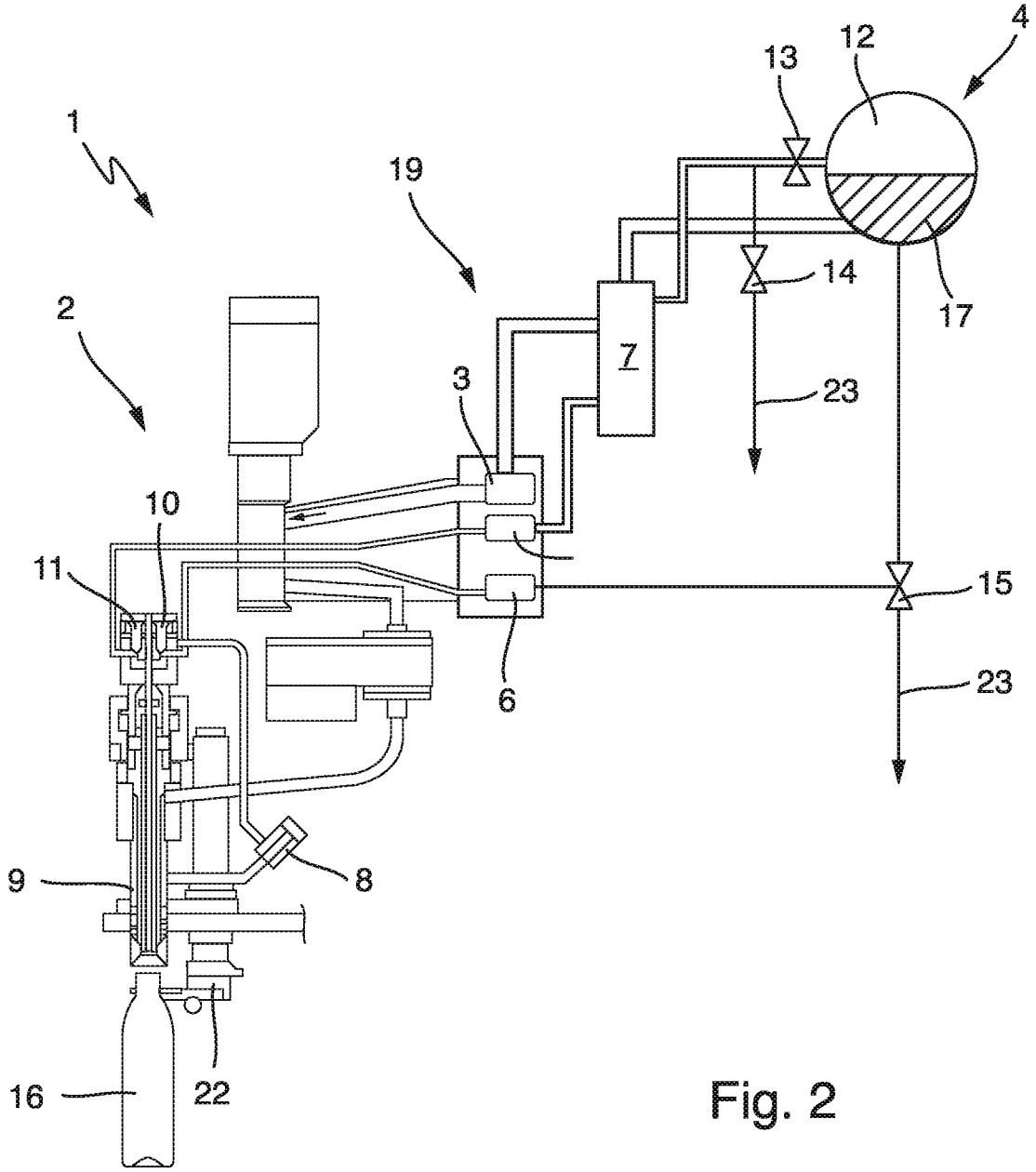
FIG. 2 is a schematic side view of a device for filling a fill product into a container to be filled according to a second embodiment.

FIG. 2 shows, schematically, a side view of a device 1 for filling a fill product 17 into a container 16 to be filled according to a further embodiment. The device 1 corresponds substantially to the device of FIG. 1, whereby there is additionally provided at the filling member 2 a return-switch valve 8 for providing a fill product stream from the filling member 2 into the second media channel 6.

The device 1 is thus adapted in a first operating state for filling a carbonated fill product 17 and in a second operating state for hot-filling a fill product 17.

The method for filling a carbonated fill product 17 in accordance with the first operating state corresponds, in the case of the device 1 of FIG. 2, to the method described hereinbefore in relation to the device of FIG. 1. The return-switch valve 8 is thereby kept continuously in a closed position.

The filling of a hot fill product 17, for example a juice, into the container 16 in accordance with the second operating state will be described hereinbelow. The fill product 17 is thereby subjected to a heat treatment before it is filled into the container 16, in order to kill germs present in the fill product 17 and achieve a predefined or required microbiological stability. The filling member 2 and the container 16 are sterilized concomitantly by the hot-filled fill product 17 during the filling operation. The filling member 2 must thereby be maintained at a corresponding temperature so that the fill product 17 in the filling member 2 does not cool before it flows into the container 16. Hot-filling is carried out without flushing or pre-pressurization.

In order to avoid the fill product 17 standing in the fill product channel 3 and/or in the filling member 2 when the filling valve 9 of the filling member 2 is closed, for example during transfer of a container 16 to the or from the container holder 22 or during a break in production and, as a result, the fill product 17 and/or the filling member 2 thereby cooling to below the required filling temperature, the return-switch valve 8 is brought into an open position, so that the filling member 2 is connected in the region of the filling valve 9 to the second media channel 5. The fill product 17 is thus able to circulate through the filling member 2 and back into the fill product reservoir 4 again via the second media channel 5 and be heated again. The relief valve 10 is thereby closed, so that no fill product 17 can enter the container 16 or pass to the environment.

The second media channel 6 further comprises a further switch valve 15, by means of which it is possible to change between fluid communication with the fill product reservoir 4 or with the environment. The second media channel 6 consequently establishes either a connection with the fill product reservoir 4 or venting to the environment, as is indicated here by means of the reference numeral 23.

Consequently, the second media channel 6 is adapted in the first operating state for relieving the gas overpressure which has built up in the container 16 after filling with the fill product 17, and is adapted in the second operating state for circulating the hot fill product 17 through the filling member 2 for controlling the temperature of the filling member 2 in the case of hot-filling.

For filling the container 16, the container 16 is first brought into contact with the filling member 2. Once the return-switch valve 8 is closed, the filling valve 9 is opened and the hot fill product 17 flows into the container 16. Because, in contrast to the filling of carbonated beverages according to the first operating state, the second media channel 6 has the function in the second operating state of circulating the hot fill product 17 through the filling member 2, the gas displaced from the container 16 during filling of the container 16 cannot flow back, as in the first operating state, via the relief valve 10 into the second media channel 6. In the second operating state, the displaced gas flows back via the first media channel 5. For this purpose, the pre-pressurizing valve 11 is open during filling.

Consequently, the first media channel 5 is adapted in the first operating state to perform the functions of flushing the container 16 before it is filled with the fill product 17, of pre-pressurizing the container 16 to a pre-pressurizing pressure before it is filled with the fill product 17, and of returning the gas displaced from the container, and is adapted in the second operating state to allow gas displaced from the container 16 during filling of the fill product 17 to flow back.

In order to prevent the gas which has been displaced from the container and has flowed back into the first media channel 5 from entering the fill product reservoir 4, an additional switch valve 13 is installed, which separates the fill product reservoir 4 from the first media channel 5. In order that a counterpressure which hinders filling does not form in the first media channel 5 as a result of the back-flowing gas, the first media channel 5 further comprises a venting valve 14 for releasing gas or gas mixture from the first media channel 5, and consequently venting it to the environment, as indicated by means of the reference numeral 23.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

Where applicable, all the individual features shown in the exemplary embodiments can be combined and/or interchanged with one another, without departing from the scope of the invention.

The invention claimed is:

1. A device for filling a fill product into a container to be filled in a beverage bottling plant, the device comprising:

a fill product reservoir for storing the fill product;

a fill product channel; and a filling member in fluid communication with the fill product reservoir via the fill product channel, wherein the filling member is configured to introduce the fill product into the container to be filled and the filling member communicates via media channels to provide media flows for two or more functions:

flushing the container with a flushing gas before it is filled with the fill product, pre-pressurizing the container with a pressurizing gas to a pre-pressurizing pressure before it is filled with the fill product, returning gas displaced during the filling of the container with the fill product, relieving a gas overpressure in the container after filling the container with the fill product, and circulating a hot fill product through the filling member for controlling a temperature of the filling member, wherein in a first operating state the fill product is carbonated and in a second operating state the fill product is a hot-fill product, and wherein a single media channel of the media channels is configured to provide the media flows for at least two of the functions, including during the first operating state the single media channel is configured to relieve the gas overpressure which has built up in the container after filling with the fill product and during the second operating state the single media channel is configured to circulate the hot fill product through the filling member for controlling the temperature of the filling member.

2. The device according to claim 1, wherein the single media channel is configured to provide the media flow to flush the container before it is filled with the fill product and to pre-pressurize the container to the pre-pressurizing pressure before it is filled with the fill product.

3. The device according to claim 1, wherein the single media channel during the first operating state is further configured to provide the media flow for flushing the container before it is filled with the fill product and to pre-pressurize the container to the pre-pressurizing pressure before it is filled with the fill product and during the second operating state is further configured to provide the media flow to allow the gas displaced from the container during filling of the fill product to flow back.

4. The device according to claim 1, wherein the single media channel comprises a further switch valve for selectively providing fluid communication with one of the following: the fill product reservoir, the fill product channel, and an environment surrounding the device.

5. The device according to claim 1, wherein the filling member includes a return-switch valve for providing a fill product stream from the filling member into the single media channel, wherein a second media channel, during the second operating state that is configured to provide the media flows for returning the gas displaced during filling of the container with the fill product, includes:

a switch valve and/or a non-return valve for preventing a gas stream from entering the fill product reservoir, and a venting valve for releasing the gas stream from the second media channel into an environment surrounding the device, wherein the venting valve is controllable/adjustable via a switch position of the switch valve and/or of the non-return valve.

6. The device according to claim 5, wherein the filling member includes a filling valve and the return-switch valve is adapted in the second operating state, with the filling valve closed, to allow the fill product which has flowed from the fill product channel into the filling member to flow into the single media channel that is configured to provide the media for circulating the hot fill product.

7. The device according to claim 1, wherein the media channels include only the single media channel and one other media channel to provide the media flows for all of the functions.

8. The device according to claim 1, wherein the fill product reservoir is in the form of an adjacent fill product reservoir and the device further comprises a media distributor arranged between the fill product reservoir and the filling member and configured to distribute the media provided by the fill product reservoir.

9. The device according to claim 1, wherein the single media channel is configured to provide the media flow for flushing and for pre-pressurizing the container is adapted to use the gas that has been displaced from the container into the single media channel during filling of the fill product into the container for flushing and/or pre-pressurizing at least one second container that is to be filled.

10. The device according to claim 1, wherein a first media channel of the media channels figured to provide a media flow for flushing and/or pre-pressurizing the container comprises a pre-pressurizing valve for connecting the filling member to the first media channel and the single media channel comprises a relief valve for releasing the gas from the filling member into the single media channel.

11. The device according to claim 1, further comprising a plurality of filling members that include the filling member.

12. The device according to claim 1, wherein the gas that has been displaced from the container during filling of the fill product into the container and returned to a media channel of the media channels is provided for pre-pressurizing at least one second container.

13. The device according to claim 1, wherein the single media channel during the first operating state is further configured to provide the media flow for flushing the container before it is filled with the fill product and to pre-pressurize the container to the pre-pressurizing pressure before it is filled with the fill product.

14. A method for filling a fill product into a container to be filled in a beverage bottling plant, the method comprising:

conveying the fill product from a fill product reservoir to a filling member;

filling, by the filling member, the container to be filled with the fill product; and using media flows via media channels in communication with the filling member to perform two or more of the following functions:

flushing the container to be filled with a flushing gas before it is filled with the fill product, pre-pressurizing the container with a pressurizing gas to a pre-pressurizing pressure before it is filled with the fill product, returning gas displaced during the filling of the container with the fill product, relieving a gas overpressure which has built up in the container after filling with the fill product, and circulating a hot fill product through the filling member for controlling a temperature of the filling member, wherein in a first operating state the fill product is carbonated and in a second operating state the fill product is a hot-fill product, and wherein a single media channel of the media channels is configured to provide the media flows for at least two of the functions, including during the first operating state the single media channel is configured to relieve the gas overpressure which has built up in the container after filling with the fill product and during the second operating state the single media channel is configured to circulate the hot fill product through the filling member for controlling the temperature of the filling member.

15. The method according to claim 14, wherein the single media channel is further configured to provide the media flow to flush the container before it is filled with the fill product and to pre-pressurize the container to the pre-pressurizing pressure before it is filled with the fill product.

16. The method according to claim 14, wherein the single media channel is further configured to flush the container before it is filled with the fill product, pre-pressurize the container to the pre-pressurizing pressure before it is filled with the fill product, and to return the gas displaced during the filling of the container with the fill product.

17. The method according to claim 14, further comprising pre-pressurizing at least one second container using the gas that has been displaced from the container during filling of the fill product into the container and returned to a media channel of the media channels.

18. The method according to claim 14, further comprising during hot-filling releasing into an environment surrounding the filling member the gas that has been displaced during filling and returned into a media channel of the media channels.

* * * * *